United States Patent [19]

Haneda et al.

[11] Patent Number: 4,500,616

[45] Date of Patent: Feb. 19, 1985

[54] EXTRACTION DEVELOPING METHOD FOR ELECTROSTATIC LATENT IMAGES

[75] Inventors: Satoshi Haneda; Masahiko Itaya; Minoru Tanaka, all of Hachioji, Japan

[73] Assignee: Konishiroku Photo Industry Co., Ltd., Tokyo, Japan

[21] Appl. No.: 419,940

[22] Filed: Sep. 20, 1982

[51] Int. Cl.[3] ..... G03G 13/08; G03G 13/09

[52] U.S. Cl. ..... 430/45; 430/97; 430/102; 430/120; 430/122

[58] Field of Search ..... 430/45, 97, 102, 120, 430/122

[56] References Cited

U.S. PATENT DOCUMENTS

| | | | |
|---|---|---|---|
| 3,010,842 | 11/1961 | Ricker | 430/45 |
| 3,236,639 | 2/1966 | Tomanek | 430/120 X |
| 3,519,818 | 7/1970 | Bean | 430/102 X |
| 4,292,387 | 9/1981 | Kanbe et al. | 430/102 |

FOREIGN PATENT DOCUMENTS

| | | | |
|---|---|---|---|
| 243022 | 6/1960 | Australia | 430/45 |
| 55-124156 | 9/1980 | Japan | 430/45 |

*Primary Examiner*—Roland E. Martin

*Attorney, Agent, or Firm*—Jordan B. Bierman

[57] ABSTRACT

An electrostatic image is developed by selectively extracting colored grains of one polarity from a mixture containing colored grains having opposite polarity to each other in the presence of an alternating field followed by development of the electrostatic image by the selectively extracted colored grains.

18 Claims, 5 Drawing Figures

EXTRACTION DEVELOPING METHOD FOR ELECTROSTATIC LATENT IMAGES

BACKGROUND OF THE INVENTION

1. Field of the Invention:

The present invention relates to a developing method for an electrostatic latent image, and particularly to a developing method obtained a multicolor images.

2. Description of the Prior Art:

The typical method for making an electrostatic latent image into the multicolored image is relating to an electrophotographic method for a color image.

Inter alia, there is such a method that document is exposed, the reflected light is color separation through an optical filter and the color-separated lights are used as the exposure light source to a photoreceptor, and that a series of charging and exposing, developing, and transfer processes is successively repeated four times in combination with the developments each to be made with yellow, magenta, cyan and black toners, respectively. Besides the above, there is another method in which heteropolar electrostatic latent images are produced on the same photoreceptor and then the developments are made with black toner and red toner.

As much these multicolor-images are of the more desired because a colored image information can still further be added, as compared with a black and white image information, it is needed to use for an apparatus provided developing devices respectively corresponding to each color for obtaining colored image information.

Accordingly, above apparatus have caused the following defects (1) that the apparatus becomes larger in size and more expensive in cost, (2) that a color shearing accuracy in repeating operations should be indispensable, and (3) that every copy-time drags on.

From the viewpoints of above defects, there have tried to make a developing device compact in size by mixing up two kinds of colored developers of which colors are different from each other in the same developing device (for example, refer to Japanese Patent Publication No. 30625/1980). However, there will cause the defects as mentioned below if such a simple mixture of two different color developers alone is used as quoted in the abovementioned citation:

(1) Even an area where is not formed an electrostatic latent image is developed, that is, a fog is formed therein.

(2) Color reproduction is worsen for causing from the other unnecessary developer intermixed into the proper developer forming a developed image, that is, a color turbidity is occured.

(3) A sharp and clear image cannot be obtained.

SUMMARY OF THE INVENTION

It is an object of the present invention to provide a developing method for an electrostatic latent image in which no fog is formed when it is developed to said latent image by making use of colored grains having the opposite polarity to each other.

It is an another object of the present invention to provide a developing method for an electrostatic latent image in which no color turbidity is formed when it is developed to said latent image by making use of colored grains having the opposite polarity to each other.

It is a still another object of the present invention to provide a developing method for an electrostatic latent image in which a sharp and clear image can be obtained when it is developed to said latent image by making use of colored grains having the opposite polarity to each other.

The abovementioned objects of the invention can be attained in an electrostatically charged image developing method characterized in that the colored grains charged to one polarity are extracted selectively from the colored grains having the opposite polarity to each other, and that an electrostatic latent image having one polarity out of the those having the opposite polarity to each other is developed, on the image support, with the aforesaid extracted colored grains.

One of the problems in developments by making use of colored grains having the opposite polarity to each other (hereinafter referred to as a complex developer) is that said developer also adheres to non-image area to cause fog.

Present inventors illustrate above problem by referring a drawing. FIG. 1 illustrates the relation between a potential of an electrostatic latent image and the amount of developer contributing to development, wherein a horizontal axis shows the potential of an electrostatic latent image and a vertical axis shows the amounts of developer contributing to development. Curve I shows the amount of a negative charged developer which adhere to an electrostatic latent image having a positive potential, and Curve II shows the amount of positive charged developer which adhere to an electrostatic latent image having a negative potential.

In FIG. 1, oblique lines III show a fogged area. When an electrical bias is merely applied to a developer support (such as a developing sleeve) so as to remove the fog caused, then a fog is caused on the other hand because the developer having the reversed polarity adhere to an image support. Consequently, the fog cannot be removed by applying the electrical bias.

To cope therewith, present inventors could be solved the problem of causing a fog by a means providing so as to extract selectively only the developer having one polarity, and the development being made with said extracted developer by said means.

DETAILED DESCRIPTION OF THE PREFERRED EMBODIMENTS

Figure 2:
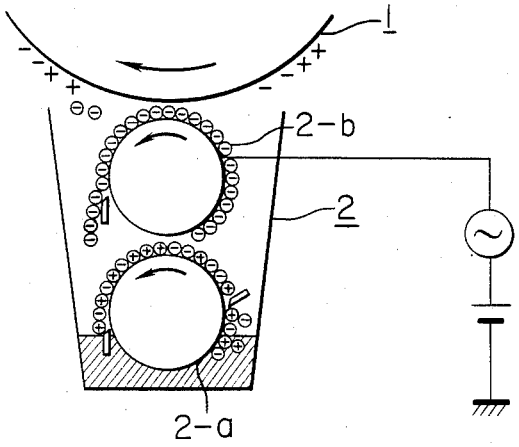
FIG. 2 and 3 show the schematic construction views of a developing device of the present invention, respectively.

In FIG. 2, numeral 1 is a photosensitive drum as a charge receptor to which a photoconductor is arranged on the surface thereof, and 2 is a developing device. Developing device 2 comprises a developing roller 2-*b* and a developer supply roller 2-*a*, and the photoreceptive drum 1, the developing roller 2-*b* and the developer supply roller 2-*a* revolve respectively in the direction of the arrow. Further, in FIG. 2, the marks, ⊕ and ⊖ show positive and negative charged colored grains, respectively. The developer supply roller 2-*a* transports only the developer having a specific polarity in the charged complex developers onto the developing roller 2-*b* by the aid of the revolution of said developer supply roller and of the action of the fixed magnets thereinside through an electric means, namely, the application of a direct current voltage.

Figure 1:
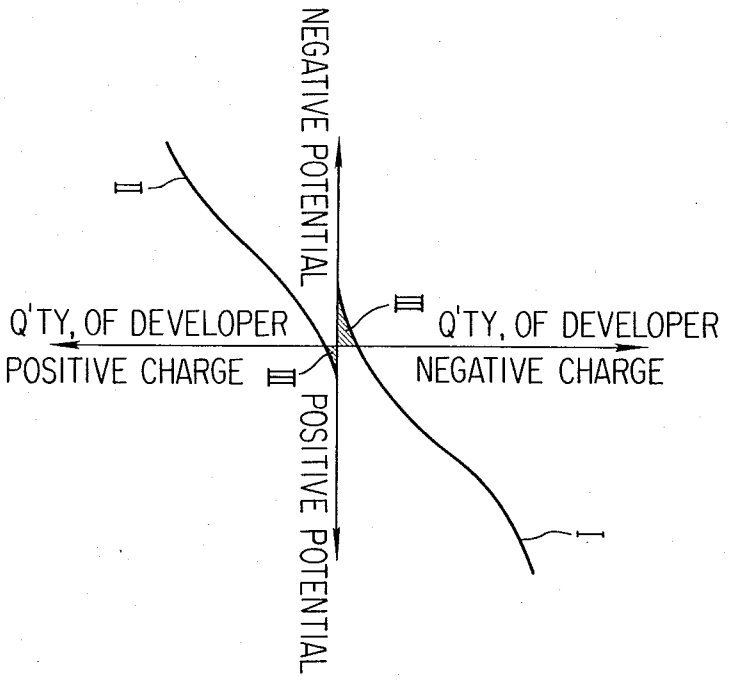
FIG. 1 shows a graph illustrating the relation between a potential of an electrostatic latent image and the amount of a developer.

The relation between the amount transported of the developers from developer supply roller 2-*a* to developing roller 2-*b* and the voltage applied through the electric means will resemble that shown in FIG. 1, and it is required to impress the voltage difference greater (e.g.; 100 V−1 KV) than a certain level to enable only the specific developer to transport.

To make the transport thereof sure, developer is to be transported from the developer supply roller 2-*a* onto the developing roller 2-*b* not by contacting but by jumping, for example. Or, it is effective to contain a magnetic substance in one or both of the complex developers. The contents of such magnetic substance in this case are preferably 5–60% by weight to the total amount of the colored grains. In the latter case, in particular, compound developers can surely be frictional charging, transporting, and prevented from leaping. In a transportation process of compound developers, there is occation where small lump including unnecessary polarity is also transported together as they are. To cope therewith, the direct current voltage shown in FIG. 2 is superposed with an alternating electric field, and thereby the lump of the complex developers is pulverized and thus only the specific developer can more easily be transported.

As for the developing method in the state that the above-mentioned alternating electric field is charged in a development, two developing methods are following typical examples. First example is a method in which an electrostatic latent image and developer on the developing sleeve are stood face to face with each other with some space to develop in an alternating electric field (for example Japanese Patent Publication Laid-Open to Public Inspection (hereinafter Japanese Patent 0.P.I. Publication) Nos. 18656/1980, 18657/1980, 18658/1980 and 18659/1980, and U.S. Pat. No. 3,890,929); and second example is a method in which the electrostatic latent image and the developer are brought into the state of contact with each other to develop in a low-frequency alternating electric field. In these technologies, it is possible to make adhere surely only the developer having such a polarity that should adhere to an electrostatic latent image by jumping or vibrating the developer, and the use of an alternating electric field is also excellently effective for making an image sharpness and clearness.

Positive or negative electrostatic latent image may be developed with a complex developer having the same color and may also be developed with a complex developer having the different color corresponding to a polarity of an electrostatic latent image. Thus, it is possible to obtain a greater number of information. In the development process, the development can be repeated in succession with processing by the developer charged to one of the polarities. It is, however, effective to process simultaneously with the complex developer, if the bipolar electrostatic latent images can be maintained on the charge receptor. For attaining this, it will do to constitute an apparatus structure as shown in FIG. 3.

Figure 3:
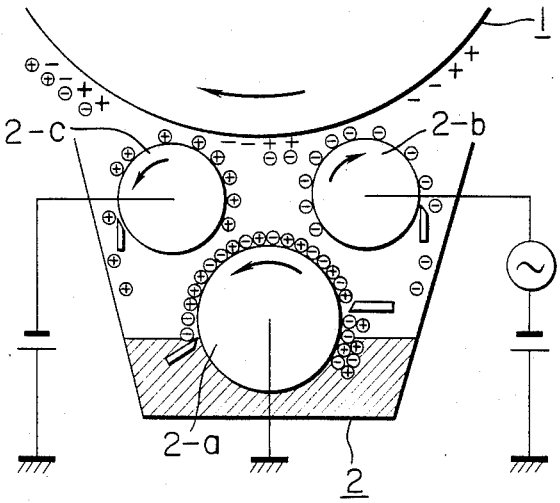

In FIG. 3, numeral 1 is the photosensitive drum, and 2 is developing device comprising two developing rollers 2-*b* and 2-*c* on each of which the developers having the opposite polarity to each other are respectively maintained. 2-*a* shows the developer supply roller. The photosensitive drum 1 and developing rollers 2-*b*, 2-*c* revolve in the direction of the arrow, respectively.

The development of bipolar electrostatic latent images on photosensitive receptor 1 are carried out in such a manner that each of the heteropolar electrostatic latent image is developed by means of developing rollers, 2-*b*, 2-*c*, respectively.

The developments are carried out in such a method that is ordinarily used in the single component development, namely, a contact developing method in which the development is made under the conditions that developer on a developing roller and an electrostatic latent image on the photoreceptor drum are brought into contact with each other, or a non-contact developing method in which no contact therewith is made. If the developer comprises a magnetic substance, it is effective to develop in a magnetic field.

In the developers to be used in the abovementioned developing methods of the present invention, it is preferable that the bipolar developers are of the heteropolar from each other and have the approximate potential of an electrostatic latent image and that the characteristics excluding the charged polarities of both of the heteropolar developers resemble each other. From the abovementioned facts, both of the developers may have the conditions such as 5–20 $\mu$ of the grain diameter, 0.2–20 $\mu$c/g of the volume of charge, the similar intensity of magnetization, the similar dielectric constant and the like, and as for the manufacturing method of such a colored developer comprising a magnetic substance, it is possible to apply the technologies, for the purpose, such as those described in Japanese Patent 0.P.I. Publication Nos. 42539/1976, 118051/1978 and 118053/1978.

The complex developer to be used in the present invention will be described hereunder.

The complex developers of the present invention are classified into a microcapsule developer and a powder developer.

The microcapsule type developer, the former, comprises ordinarily a core material, a synthetic resin made coat which is outside of the core, and a magnetic substance contained in at least either of the two.

In the present invention, the particularly preferable developer comprises a core material, primary wall coat comprising a film formable polymer on the outside of said core material and a secondary wall coat comprising a synthetic resin and a magnetic substance therein dispersed on the outside of said primary wall coat. Among the capsulation methods thereof, there are the well-known microcapsulation methods such as a complex coacervation method, a simple coacervation method, a salt coacervation method; a method for separating a phase from a water-soluble or an aqueous dispersion liquid for making a polymer insoluble by a pH value change, a solvent change or a solvent removement; an interfacial polymerization method; an In Situ polymerization method; and the like.

Now, with reference to a complex coacervation method that is a popular one, a non-aqueous solution or a non-aqueous dispersion liquid containing a coloring agent is added in an aqueous solution containing a film formable polymer (such as a gum arabic) that has been adjusted to a prescribed pH value to be alkalified, a prescribed density and a prescribed temperature, and the solution thus obtained is dispersively emulsified. There adds thereto with an aqueous solution of a film formable polymer (such as gelatin) that is a gelatinizable isoelectronic colloid having been adjusted to the same pH value, density and temperature with those of the above. Next, a phase separation is caused by acidifying the pH of the mixed solution thus prepared. Thereby, both of the aforementioned polymer are deposited out around the drops of the non-aqueous solution or the non-aqueous dispersion liquid containing the coloring agent, and next, the solution is cooled, and said polymers are hardened by adding a hardening agent such as formalin and by alkalifying and by raising the temperature. Further, to the solution thus obtained containing a cupsule, at least magnetic grains and synthetic resin emulsion are added and uniformly dispersed and thereafter jet-dried up, and thus the directing developer can be obtained.

As for the coloring agents to be used as the core materials, there are given an inorganic pigment, an organic pigment, a direct dye, an acid dye, a basic dye, a mordant, an acid mordant, a disperse dye, an oil soluble dye and the like. The concrete examples thereof are given as follows:

For black pigments: carbon black, acetylene black, lamp black, graphite, mineral black, aniline black, cyanine black and the like.

For yellow pigments: chrome yellow, zinc yellow, barium chromate, cadmium yellow, lead cyanamide, calcium plumbate, naphthol yellow S, hanza yellow-3G, hanza yellow-G, hanza yellow-GR, hanza yellow-A, hanza yellow-RN, hanza yellow-R, pigment yellow-L, benzine yellow, benzine yellow-G, benzine yellow-GR, permanent yellow-NCG, Balkan fast yellow-5G, Balkan fast yellow-R, tartrazine lake, quinoline yellow lake, anthragen yellow-5GL, permanent yellow FGL, permanent yellow-H10G, permanent yellow-HR, anthrapyrimidine yellow and the like.

For red pigments: iron oxide red, minium silver vermilion, cadmium red, permanent red 4R, Rose red, fire red, occidental vermilion, p-chlororthonitroaniline red, resol fast scarlet G, brilliant fast scarlet, brilliant carmine BS, permanent red F2R, permanent red F4R, permanent red FRL, permanent red FRLU, permanent red F4RH, fast scarlet VD, Balkan fast rubin B, eosine lake, rhodamine lake, rhodamine lake Y, alizarine lake, thioindigo red B, thioindigo maroon, permanent red FGR, PV carmine HR and the like.

For blue pigments: ultramarine blue, Prussian blue, cobalt blue, alkaline blue lake, peacock blue lake, victoria blue lake, non-metal phthalocyanine blue, phthalocyanine blue, fast sky blue, indanthrene blue RS, indanthrene blue BS, indigo and the like.

For yellow dyes: C.I. (that stands for Color Index) Direct Yellow 98, C.I. Direct Yellow 89, C.I. Direct Yellow 88 (the foregoing are the substantive dyes); C.I. Basic Yellow 1, C.I. Basic Yellow 2, C.I. Basic Yellow 11 (the foregoing are the basic dyes); C.I. Mordant Yellow 26 (a Mordant.Acid mordant dye); C.I. Disperse Yellow 1, C.I. Disperse Yellow 3, C.I. Disperse Yellow 4 (the aforegoing are the disperse dyes); C.I. Solvent Yellow 2, C.I. Solvent Yellow 6, C.I. Solvent Yellow 14 (the foregoing are the oil dyes); and the like.

For red dyes: C.I. Direct Red 1, C.I. Direct Red 2, C.I. Direct Red 4 (the foregoing are the substantive dyes); C.I. Acid Red 8, C.I. Acid Red 13, C.I. Acid Red 14 (the foregoing are the acid dyes); C.I. Basic Red 2, C.I. Basic Red 14, C.I. Basic Red 27, (the foregoing are the basic dyes); C.I. Mordant Red 21 (a Mordant.Acid mordant dye); C.I. Disperse Red 1, C.I. Disperse Red 4, C.I. Disperse Red 5 (the foregoing are the disperse dyes); C.I. Solvent Red 1, C.I. Solvent Red 3, C.I. Solvent Red 8 (the foregoing are the oil dyes); and the like.

For blue dyes: C.I. Direct Blue 1, C.I. Direct Blue 6, C.I. Direct Blue 22 (the foregoing are the substantive dyes); C.I. Acid Blue 1, C.I. Acid Blue 7, C.I. Acid Blue 22, (the foregoing are acid dyes); C.I. Basic Blue 7, C.I. Basic Blue 9, C.I. Basic Blue 19 (the Basic dyes); C.I. Mordant Blue 48 (that is a mordant.Acid mordant dye); C.I. Disperse Blue 1, C.I. Disperse Blue 3, C.I. Disperse Blue 5 (the foregoing are the disperse dyes); C.I. Solvent Blue 2, C.I. Solvent Blue 11, C.I. Solvent Blue 12 (the foregoing are the oil dyes); and the like.

It is also allowable to add a material having a low melting point such as paraffin wax, a water glass or the like into the solution or the dispersion liquid in order to prevent the inner contents from releasing or to give the developer obtained with some binding property to an image acceptor. The contents of the coloring agent in the solution or the dispersion liquid is at 0.005–10% by weight, and preferably at 0.01–5% by weight.

Also, as for the film formable polymer to constitute the primary wall-coat (i.e; the inner wall-coat), there can be exemplified, besides the aforementioned gum arabic and gelatin, as collagen, casein, fibrinogen, hemoglobin, a polyamino acid, agar, sodium alginate, carrageenin, konjakmannan; a dextran sulfate, ethyl cellulose, nitrocellulose, carboxymethyl cellulose, acetyl cellulose, polyamide, polyester, polyurethane, polycarbonate, formalin-naphthalene sulfonic acid condensate, amino resin, alkyd resin, silicone resin, a maleic anhydride copolymer such as ethylene, vinylmethylether, acrylic acid, a methacrylic acid copolymer, polyvinyl chloride, polyvinylidene chloride, polyethylene, polystyrene, polyvinyl acetal, polyacrylamide, polyvinyl benzene sulfonic acid, polyvinyl alcohol, a synthetic rubber, and the like.

Further, as for the synthetic resins to form a secondary wall-coat (i.e.; the outer wall-coat), there can be exemplified as polycarbonate, a polyester, a polyamide, polyether, polyolefin such as polystyrene, a styrene-acrylate copolymer, a styrene-methacrylate copolymer, a styrene-ethylenically unsaturated monolefin copolymer, a styrene-vinyl ester copolymer, a styrene-vinyl ether copolymer, a styrene-acrylonitrile copolymer, styrene-methacrylonitrile copolymer, a styrene-acrylamide copolymer, styrene-$\alpha$-methylene monocarbocylic acid ester copolymer, a styrene-vinylidene halide copolymer, polyvinyl acetate, and a binary or not less than tertiary copolymer thereof or the mixtures of these copolymers, and the like, and every of which can be used in the state of an aqueous dispersion solution.

For the magnetic substances to be mixed in the above-mentioned synthetic resin, there can be exemplified as a metal such as cobalt, iron and nickel; an alloy or the mixture of metals such as aluminium, cobalt, copper, iron, lead, magnesium, nickel, tin, zinc, gold, silver, antimony, beryllium, bismuth, cadmium, calcium, manganese, selenium, titanium, tungsten, vanadium, and zirconium; a metal compound including a metal oxide such as aluminium oxide, iron oxide such as magnetite, copper oxide, nickel oxide, zinc oxide, zirconium oxide, titanium oxide, and magnesium oxide; a fire resistible nitride such as chrome nitride; a carbide such as tungsten carbide and silica carbide; ferromagnetic ferrite and the mixtures thereof.

It is also preferable to use a colored magnetic substance in order to improve the color clearness to serve as a magnetic substance.

As for the suitable colored magnetic substances to be used in a colored developer, there are given the examples; as to magenta use, such as iron oxide (i.e.; iron oxide red), those coated with copper oxide on the Ni surface thereof, and those absorbed cadmium red in Ni; as to cyan use, such as cobalt and the compounds thereof; and as to yellow use, such as iron oxide and those absorbed cadmium yellow on Ni. Every of the colored magnetic substances produces fine grains through a deposition method so as to make the surface thereof glossy or a chemical surface treatment is applied thereto after pulverizing.

The contents of the magnetic substance are suitably at the ratio of 20–70% by weight to the total amount of developers and more preferably 40–60% by weight thereto.

Next, the latter, the powdered developer will be described.

Powdered developer means that comprises dispersively coloring agent and magnetic substance or colored magnetic substance in the transparent resins.

To serve as the magnetic substance to be contained in developer, there uses such a one that effectively and selectively reflects the color of colored developer when the developer are superposed thereon, and to serve as the fesins in the developer, there uses a resin that has such a color capable of compensating and enriching the color of the magnetic substance or that is mixed with dyed or colored substance to compensate and enrich the same, and thus there arranges so as to superpose on each other directly.

It is desirable that the magnetic substance has the grain diameter of 0.5–10$\mu$ and that the surface thereof is smooth and glossy in a textile or globular shape. Such a grain as above is produced in anyone of the manners that colorless or colored magnetic substance are put into colored transparent resin or transparent resin into which dyes or pigments are mixed up, or that magnetic substance of which the surface is coated with transparent or translucent coloring agent are put into colorless transparent resins or transparent resins into which dyes or pigments are mixed up in the case that the color reproduction is attained insufficiently with the color of the magnetic substance. The proportion of resins is 1–50 by volume to one part of magnetic substance in the case of using in the developers for superposing use, and the preferable grain diameter thereof to serve as a developer is 5–20$\mu$.

Magnetic substance and the coloring agent to be used in the abovementioned developer are common to microcapsule developer, and the colored magnetic substance is also common thereto.

As for the resins to be used for coating, there are given the examples such as phenol, polyester, styrene, alkyd, acryl, polyethylene and the like.

In the case of using a two-component developer, it may be allowed not always to contain any magnetic substance or colored magnetic substance in the developer.

The copying process of the present invention is to be performed as mentioned hereunder:

There have been known the two methods for forming an electrostatic latent image. One of those methods is that a primary charge at the prescribed polarity is applied on a photosensitive receptor to which two photoconductive layers whose characteristics of the spectrosensitivity are different from each other are laminated on a conductive support and then a secondary charge at the reversed polarity to that of said primary charge is applied, and the electric double layer is formed on each photoconductive layer of the photosensitive receptor so that the bipolar moments of the electric double layer may be able to generate in opposite directions, and an image of a document is irradiated and the surface potential of the photosensitive receptor is made to zero approximately in the area corresponding to the ground area of the document, and at the same time, an electrostatic latent image area corresponding to each of the color image is thus formed by the surface potential distributions of the photosensitive receptor in the reversed polarity to each other.

Another method is that an electrostatic latent image is formed on a photosensitive receptor by positive and negative recording signals generated by means of a multistyrus electrode.

An electrostatic latent image produced in one of the above-mentioned methods is developed by the complex developer, and the developed image is transferred to and fixed to a recording paper after arranged the polarities by corona charging the developed image by means of a corona charger after transferring, the residual developer on the photosensitive receptor is cleaned up by a cleaning device and remaining electrostatic latent image is eliminated by a charge eliminating corona charger, and thus the receptor can be repeatedly used.

The present invention will be described with reference to the examples.

EXAMPLE 1

As for a positively charged black developer,

| | |
|---|---|
| Ferrite powder | 40 g |
| Polyester resin | 50 g |
| Carbon black | 10 g |
| Nigrosine (mfd. by Orient Chemical Co. Nigrosine EX) | 1 g |

The above-given chemicals were mixed, heated, melted and then cooled. The matter thus prepared was pulverized and classified so that the average grain diameter can be 15$\mu$, and 0.2% of silica was added as the fluidizing agent.

On the other hand, as for the negatively charged red developer,

| | |
|---|---|
| Iron powder | 10 g |
| Polyester resin | 60 g |
| Vermilion | 30 g |
| Gold containing dye (mfd. by Orient Chemical Co. Valifast 3104) | 1 g |

The above-given chemicals were mixed, heated, melted and cooled. The matter thus prepared was pulverized and classified so that the average grain diameter can be 15$\mu$ and 0.2% of silica was added thereto as the fluidizing agent.

Figure 4:
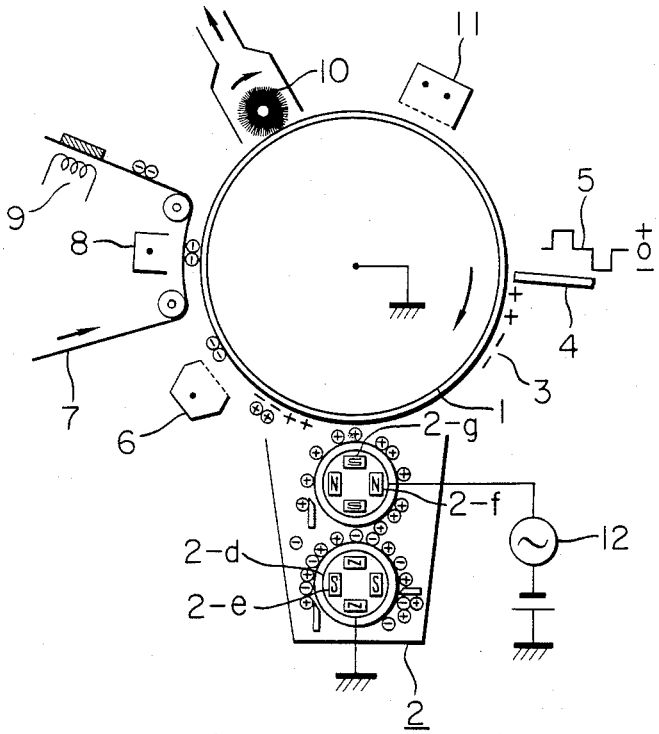
FIG. 4 and 5 show the schematic construction diagrams illustrating the examples of the present invention, respectively.

The abovementioned developers were mixed up to the equivalent proportion by volume and the development was carried out in the developing device shown in FIG. 4. The mixture ratio thereof is desired to be around the equivalence and even if the difference of the mixture ratio would be greater it would particularly be desired that the difference is not in excess of 2:8.

FIG. 4 shows a schematic construction diagram exemplifying an example of the present invention, wherein numeral 4 indicates a multistyrus electrode that forms an electrostatic latent image on the photosensitive receptor 1 by sensing a positive or a negative recording signal. 2 is a developing device that develops the electrostatic latent image 3. 6 is a corona charger that arranges the charged polarities of developer in one order. 7 is a recording paper made of a plain paper. 8 is a corona charger for transfer use to transfer an image to the recording paper 7. 9 is a heater for fixing. 10 is a fur brush for cleaning and 11 is a corona charger for eliminating.

In the experiment, as for the derivative, there used a polyethylene terephthalate (PET) of which the back surface was aluminium-vacuum-evaporated, and the negative electrostatic latent image only out of the electrostatic latent images 3 of +400 V and −400 V was developed with black developer by means of a developing device 2.

Magnetic brush type developing device 2 comprises a developer supply roller rotatable comprising a rotatable sleeve 2-*d* and a fixed magnets 2-*e* arranged inside said sleeve 2-*d*, and a developer roller facing to the electrostatic latent image 3 comprising a rotatable sleeve 2-*f* and fixed magnets 2-*g* arranged inside said sleeve 2-*f*, and said developing device 2 transports the developer for developing. The development was carried out in such a manner that 0.3 mm of spece were maintained between the photosensitive receptor and sleeve 2-*f*, and with transporting a developer layer of 0.2 mm in thickness in such state the alternating current of 1 KV, 500 Hz and −500 V direct current voltage were applied to the developing roller. In the case of not applying such alternating current, there observed a mixture of red developer and the image sharpness was also poor.

Next, the developer was charged by means of the corona charger 6 to arrange the polarities into the negative and was then transferred to the recording paper 7 by means of the corona charger for transferring 8 and thus was heated and fixed by means of the fixing heater 9. And, corona charger for eliminating 11 was set at zero potential and alternating corona was applied, and thus the electric elimination was thereby carried out.

In the case of developing the positive only with red developer, the abovementioned steps were carried out by changing the applied voltage from −500 V to +500 V.

As was described above, in this example, the positive and negative electrostatic latent images were formed on the surface of the photosensitive receptor, the developments thereof were made, under the magnetic bias, with the complex developer by making use of alternating electric field generated by the polarities of the developers, and the respective polarities were arranged into one order by corona-charging, and thus the transferring and fixing were made onto a recording paper. Accordingly, high quality recording in two colors can be made on a plain paper at a high speed.

In the case of using a pressure transfer method as a transfer method, corona chargers 6 and 8 are not necessarily used.

EXAMPLE 2

With the present invention, it is possible to develop the electrostatic latent image having respectively different polarities by turns, but it is also possible to develop them at the same time.

At this time the description will be made on the example of developing the bipolar electrostatic latent images formed in an electrophotographic method.

Figure 5:
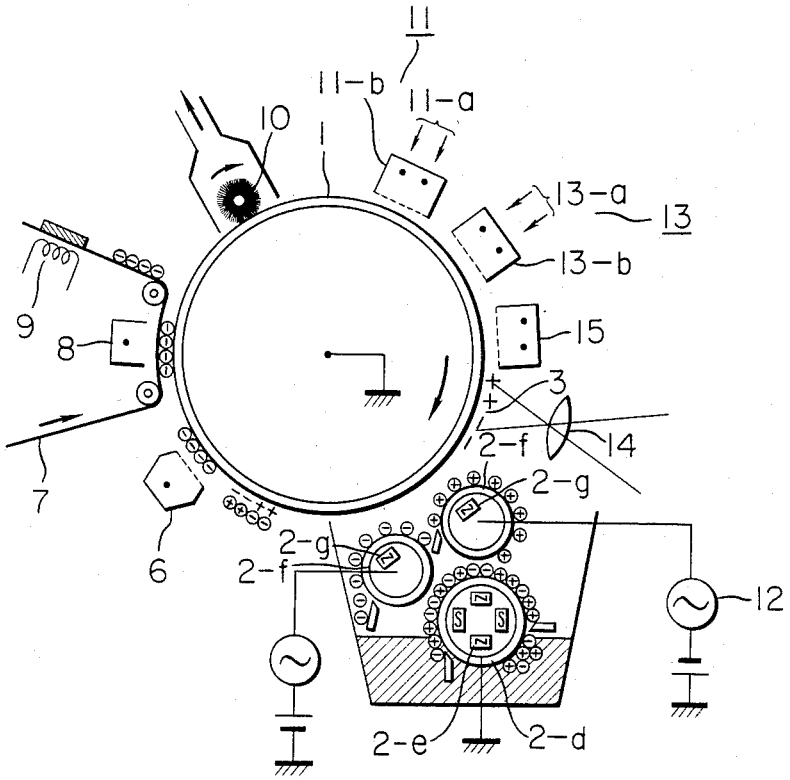

FIG. 5 illustrates a schematic diagram of the construction of an example of the present invention, wherein numeral 13 is an optical system combined red light 13-*a* with a corona charger 13-*b*, 14 is an exposure system and 15 is a corona charger. These form an electrostatic latent image on the photosensitive receptor 1. 2 is a developing device to develop the electrostatic latent image 3, 6 is a corona charger for arranging the charged polarities of developers into one order, 7 is a recording paper made of a plain paper, 8 is a corona charger for transferring the developer image onto recording paper 7, 9 is a fixing heater, 10 is a cleaning fur-brush, 11 is an optical system combined eliminating corona charger 11-*b* with white light 11-*a*.

The electrostatic latent image was formed in the following method:

Onto an aluminium plate that serves as the conductive support; selenium of the purity at 99.99% was vacuum-evaporated so as to be 12μ in thickness. Onto the selenium layer, polyvinyl carbazole-trinitro fluorenone was coated so as to be 18μ in thickness. The mixture proportion of polyvinyl carbazole and trinitrofluorenone was 0.1 mol of trinitrofluorenone to a unit monomer of polyvinyl carbazole. The selenium layer and the polyvinyl carbazol-trinitro fluorenone layer (hereinafter referred to as an OPC layer) were both bipolar chargeable and the latter was translucent.

The photosensitive receptor 1 was uniformly exposed to red light 13-*a* that was obtained by means of a red filter VR-64 mfd. by Toshiba and during which the primary charge was made up to +700 V by means of +6.0 KV corona charger 13-*b* and the charge was then made up to −400 V in the dark by means of −5.2 KV corona charger 15.

In succession, when document having both of red colored image and black colored image on the white background was exposed optical-imagewise by means of the exposure system 14, the surface potentials of the photosensitive receptor was distributed in the area corresponded to the white back-ground of the document at −30 V and in the electrostatic latent image areas corresponded to the red image and the black image were at +300 V and −400 V respectively, and thus the electrostatic latent images were formed.

The latent images thus formed were developed in magnetic brush type developing device 2 with the complex developer as has been used in Example 1. The magnetic brush type developing device 2 comprises a developer supply roller comprising a rotatable sleeve 2-*d* and fixed magnets 2-*c* arranged thereinside, and two pieces of the developing rollers comprising rotatable sleeves 2-*f*, 2-*f* and fixed magnets 2-*g*, 2-*g* oppositely arranged thereinside to electrostatic latent image 3 so as to transport the developers and then develop the images. The development was carried out in such a manner that 0.3 mm of space were maintained between the photosensitive receptor 1 and sleeve 2-*f*, and with transporting a developer layer of 0.4 mm in thickness in such state the alternating current of 0.4 KV, 1500 Hz and ±500 V direct current voltage were applied to the respective developing rollers. In the case of not applying such alternating current, there observed a mixture of red developer and black developer in the image, and the image sharpness was also poor. Next, the respective developers were charged by means of corona charger 6 to arrange the polarities into the negative and were then transferred to recording paper 7 by means of corona charger for transferring 8 and thus was heated and fixed by means of fixing heater 9. And, corona charger for eliminating 11 was set at zero potential and alternating corona and a white light were applied, and thus the electric elimination was thereby carried out.

As was described above, in this example 2, the positive and negative electrostatic latent images were formed on the surface of the photosensitive receptor, the developments thereof were made, under the magnetic bias capable of preventing fog from occurring, with the compound developers by making use of alternating electric field for improving an image, which was generated by the polarities of the developers, and the respective polarities were arranged into one order by corona-charging, and thus the transferring and fixing were made onto a recording paper. Accordingly, there is such an advantage that high quality recording in two colors can be made on a plain paper at a high speed.

In the case of using a tacky transfer as a transfer method, corona chargers 6 through 8 are not necessarily used.

What is claimed is:

1. A method of develping an electrostatic latent image on a charge receptor, said image having a first charge, comprising selectively extracting, in the presence of an alternating field, first colored grains having a second charge of polarity opposite that of sid first charge from a mixture of colored grains of different polarities, and thereafter developing said latent image with said extracted colored grains.

2. The method of claim 1 wherein said first field is superimposed over a direct current voltage.

3. The method of claim 1 wherein said development is carried out in the presence of a second alternating electric field.

4. The method of claim 3 wherein said second field is superimposed over a direct current voltage.

5. The method of claim 1 wherein said colored grains comprise a magnetic substance and a resin.

6. The method of claim 5 wherein said colored grains comprise a core material, a primary wall coat thereon comprising a film formable polymer, and a secondary wall coating outside said primary wall coat wherein said secondary wall coating comprises a resin and a magnetic substance dispersed therein.

7. The method of claim 6 wherein said core material further comprises a coloring agent.

8. A method of developing a plurality of electrostatic latent images on a charge receptor, each of said images independently having first charges and wherein at least two differently charged images are present comprising selectively extracting colored grains from a mixture of colored grains having second charges of polarity opposite those of said first charges, in the presence of an alternating electric field, and thereafter developing said images with said extracted colored grains.

9. The method of claim 8 wherein said first field is superimposed over a direct current voltage.

10. The method of claim 8 wherein said development is carried out in the presence of a second alternating electric field.

11. The method of claim 10 wherein said second field is superimposed on a direct current voltage.

12. The method of claim 8 wherein said colored grains comprise a magnetic substance and a resin.

13. The method of claim 12 wherein said colored grains comprise a core material, a primary wall coated thereon comprising a film formable polymer, and a secondary wall coating outside said primary wall coating wherein said secondary wall coating comprises a resin and a magnetic substance dispersed therein.

14. The method of claim 13 wherein said core material further comprises a coloring agent.

15. The method of claim 8 wherein said charge receptor comprises a conductive support and two photoconductive layers lamenated on said support wherein said photoconductive layers have spectrosensitivity characteristics which are different from each other.

16. A method of developing electrostatic latent image on a charge receptor and having a first charge comprising selectively extracting, in the presence of a first electric field, colored grains having a second charge of polarity opposite that of said first charge from a mixture of colored grains of different polarities, and developing said latent image with said extracted colored grains, said selective extraction being carried out by an extracting means comprising a roller in contact with a supply of said colored grain mixture, said roller in close proximity to secondary charged rollers, such that particles of a particular polarity transfer, by electrostatic attraction, to said secondary rollers and wherein said secondary rollers are in close proximity to said electrostatic latent image so that the colored grains on said secondary rollers are transferred by electrostatic attraction to said latent image.

17. A method of developing an electrostactic latent image on a charge receptor, said image having a first charge comprising selectively extracting, in the presence of a first electric field, colored grains having a second charge of polarity opposite that of said first charge from a mixture of colored grains of different polarities, and developing said latent image with said extracted colored grains, said selective extraction being carried out by an extracting means comprising a member in contact with a supply of said colored grain mixture, said member in close proximity to secondary charged members, such that particles of a particular polarity transfer, by electrostatic attraction, to said secondary members and wherein said secondary members are in close proximity to said electrostatic latent image so that the colored grains on said secondary members are transferred by electrostatic attraction to said latent image.

18. A method of developing an electrostatic latent image on an image receptor comprising selectively extracting a colored grain having a charge of a first polarity from a mixture of different colored grains wherein the grains of one color in the mixture have polarities different from the grains of a second color in the mixture, wherein said mixture is on a developer supply member and said grains to be extracted are extracted therefrom onto a developing member in the presence of an electric field, and thereafter developing aid latent image.

* * * * *